US005392860A

United States Patent [19]

Ross

[11] Patent Number: 5,392,860

[45] Date of Patent: Feb. 28, 1995

[54] HEAT ACTIVATED SAFETY FUSE

[75] Inventor: Richard J. Ross, Houston, Tex.

[73] Assignee: Baker Hughes Incorporated, Houston, Tex.

[21] Appl. No.: 31,648

[22] Filed: Mar. 15, 1993

[51] Int. Cl.[6] ..... E21B 23/04

[52] U.S. Cl. ..... 166/376; 166/63; 166/65.1; 175/4.54; 102/222

[58] Field of Search ..... 166/65.1, 63, 376; 175/4.54; 102/222; 337/407, 413

[56] References Cited

U.S. PATENT DOCUMENTS

| | | | |
|---|---|---|---|
| Re. 25,846 | 8/1965 | Campbell . | |
| 2,637,402 | 5/1953 | Baker et al. . | |
| 2,640,547 | 6/1953 | Baker et al. . | |
| 2,655,993 | 10/1953 | Spencer . | |
| 2,692,023 | 10/1954 | Conrad . | |
| 2,695,064 | 11/1954 | Ragan et al. . | |
| 2,996,591 | 8/1961 | Thomas . | |
| 3,327,792 | 6/1967 | Boop | 175/4.54 |
| 3,398,803 | 8/1968 | Leutwyler et al. | 175/4.52 |
| 4,084,147 | 4/1978 | Mlyniec et al. | 337/407 |
| 4,085,397 | 4/1978 | Yagher, Jr. | 337/407 |
| 4,266,613 | 5/1981 | Boop | 166/299 |
| 4,284,235 | 8/1981 | Diermayer et al. | 236/1 G |
| 4,306,628 | 12/1981 | Adams, Jr. et al. | 175/4.56 |
| 4,457,383 | 7/1984 | Boop | 175/4.55 |
| 4,619,320 | 10/1986 | Adnyana et al. | 166/65.1 |
| 4,640,354 | 2/1987 | Boisson | 166/64 X |
| 4,796,708 | 1/1989 | Lembcke | 166/66.4 X |
| 5,052,489 | 10/1991 | Carisella | 166/297 |
| 5,070,788 | 12/1991 | Carisella et al. | 102/222 |
| 5,159,145 | 10/1992 | Carisella et al. | 89/1.15 |
| 5,159,146 | 10/1992 | Carisella et al. | 89/1.15 |
| 5,165,489 | 11/1992 | Langston | 175/4.54 |

OTHER PUBLICATIONS

SPE Paper No. 22556, Carisella et al, Three New Systems That Prevent Firing of Perforating Guns and String Shots On or Near the Surface, Oct. 1991.

*Primary Examiner*—Terry Lee Melius

*Attorney, Agent, or Firm*—Melvin A. Hunn; Mark W. Handley

[57] ABSTRACT

A method and an apparatus for use in a wellbore are provided to prevent an electrical current from passing between a power supply and an electrically operated downhole well tool until after the electrically operated downhole well tool is positioned downhole within the wellbore. A temperature sensitive member prevents a biased member from moving from a first position to a second position until after the temperature sensitive member has been heated to an activation temperature, at which the temperature sensitive member softens to allow the biased member to move through the temperature sensitive member and to the second position for electrically connecting between the power supply and the electrically operated downhole well tool.

40 Claims, 6 Drawing Sheets

HEAT ACTIVATED SAFETY FUSE

BACKGROUND OF THE INVENTION

1. Field of the Invention

This invention relates in general to a method and apparatus for use to prevent actuation of a downhole well tool until the downhole well tool is downhole within a wellbore, and in particular to a heat activated safety fuse for use in a wireline pressure setting assembly to prevent actuation of the wireline pressure setting assembly until after it is lowered downhole within a wellbore.

2. Background of the Invention

Prior art downhole well tools include electrically operated downhole well tools which present hazards to both wellsite operators, and wellsite equipment and operations, if they are operated at the ground surface of the wellbore. A few examples of such downhole well tools are those which use explosive materials to either provide explosive forces to perform work within a wellbore, such as perforating guns, tubing cutters, and backoff shots. Another example of such downhole well tools are squibs and solenoids, which are for releasing mechanical members within wellbores. Still another example are downhole well logging tools which release radiation or radioactive materials. Yet another example is a wireline pressure setting assembly for converting a chemical source into a force over a distance for performing work in setting packers, bridge plugs, and similar devices within wellbores.

For example, one such prior art downhole well tool is a cable conveyed bridge plug for setting within a cased wellbore such as that shown in U.S. Pat. No. 2,637,402, entitled "Pressure Operated Well Apparatus," invented by R. C. Baker et al., and issued to Baker Oil Tools, Inc. on May 5, 1953. A similar cable conveyed downhole well tool is disclosed in U.S. Pat. No. 2,695,064, entitled "Well Packer Apparatus," invented by T. M. Ragan et al., and issued to Baker Oil Tools, Inc. on Nov. 23, 1954. These patents disclose cable conveyed downhole well tools for setting a bridge plug within a wellbore casing. These cable conveyed downhole well tools were actuated by the percussion of a firing pin causing a cartridge to explode and ignite a prior art power cartridge, or combustible charge.

Another example of a prior art wireline conveyed well packer apparatus is disclosed in U.S. Pat. No. Re. 25,846, entitled "Well Packer Apparatus," invented by D. G. Campbell, and issued to Baker Oil Tools, Inc. on Apr. 31, 1965. The wireline conveyed well packer apparatus disclosed includes a power charge which is ignited to generate gas for setting the well packer apparatus within a wellbore. The power charge is ignited by passing an electric current down the wireline and exploding an igniter cartridge, which causes a flame to ignite the power charge.

An example of a prior art power charge for use in downhole well tools to generate a gas to provide a force is a combustion charge disclosed in U.S. Pat. No. 2,640,547, entitled "Gas-Operated Well Apparatus," invented by R. C. Baker et al., and issued to Baker Oil Tools, Inc. on Jun. 2, 1953. The combustion charge is comprised of combustion materials which, when ignited within a downhole well tool disclosed in the patent, will take at least one second for a maximum pressure to be attained within the downhole well tool. This prior art combustion charge includes both a fuel and a self-contained oxygen source. The combustion charge is ignited to generate a gas having a pressure which provides a force for setting the gas-operated well apparatus. The combustion charge of the gas-operated well apparatus is ignited by exploding an igniter to start the combustion reaction for burning the combustion charge. The combustion charge, once ignited, burns in a self-sustained combustion reaction to generate the gas.

A prior art wireline pressure setting assembly disclosed in U.S. Pat. No. 2,692,023, entitled "Pressure Operated Subsurface Well Apparatus," invented by M. B. Conrad, and issued to Baker Oil Tools, Inc. on Oct. 19, 1954. This wireline conveyed downhole well tool includes a power charge which is burned in a combustion reaction to generate a gas. The power charge is ignited by electrically exploding an igniter cartridge which then emits a flame to start the power charge burning. Combustion of the power charge generates the gas having a pressure which provides force for operation of the wireline setting tool to set a downhole tool such as a packer or bridge plug within the wellbore.

Each of the above-referenced patents, U.S. Pat. No. 2,640,547, U.S. Pat. No. Re. 25,846, U.S. Pat. No. 2,695,064, U.S. Pat. No. 2,637,402, and U.S. Pat. No. 2,692,023, are hereby incorporated by reference as if fully set forth and disclosed herein.

The above prior art downhole well tools for converting the chemical components of a power charge into a mechanical force exerted over a distance typically require a separate igniter cartridge for igniting the power charge. Additionally, other pyrotechnic wellbore devices utilize an igniter, as well as incorporate an igniter into a singular package with the pyrotechnic device. Typically, explosive components are used for prior art igniter materials, such as, for example, gunpowder or lead azide. These types of igniter materials are easily ignited and represent hazards both to operators utilizing these materials in downhole well tools, and to successful completion of wellsite operations. Some of these types of primary ignition or igniter materials are susceptible to ignition from applications of small amounts of electric current, or even discharge of static electricity.

Wellsite operations utilizing prior art downhole well tools which present hazards if operated outside of the wellbore would be safer if prevented from operating until lowered downhole within a wellbore. Such a safety feature would enhance operator safety, as well as promote successful wellsite operations.

SUMMARY OF THE INVENTION

It is one objective of the present invention to provide a method and apparatus for use in a wellbore to prevent an electrical current from passing between a power supply and an electrically operated downhole well tool until after the apparatus is positioned downhole within the wellbore.

It is another objective of the present invention to provide a method and apparatus for use in a wellbore to automatically complete an electrical circuit for passing an electric current between a power supply and an electrically operated downhole well tool after the electrically operated downhole well tool is lowered downhole within the wellbore.

It is yet another objective of the present invention to provide a method and apparatus for use in a wellbore to automatically connect between a power connector and a means for igniting a propellant within a wellbore pressure setting assembly once the wellbore pressure setting assembly is lowered downhole within the wellbore.

It is further another objective of the present invention to provide a method and apparatus for use in a wellbore to automatically connect a power connector to a means for igniting a propellant within a wireline pressure setting assembly once the wireline pressure setting assembly is lowered downhole within the wellbore.

These objectives are achieved as is now described. A method and an apparatus for use in a wellbore are provided to prevent an electrical current from passing between a power supply and an electrically operated downhole well tool until after the electrically operated downhole well tool is positioned downhole within the wellbore. A biasing means urges a biased member to move from a first position, for preventing the electrical current from passing from the power supply to the electrically operated device, to a second position, for allowing the electrical current to pass from the power supply to the electrically operated device. A temperature sensitive member prevents the biased member from moving from the first position to the second position until after the temperature sensitive member has been heated to an activation temperature, at which the temperature sensitive member softens to allow the biased member to move through the temperature sensitive member, and to the second position. Once in the second position, electrical current may be passed between the power supply and the electrically operated downhole well tool.

In the preferred embodiment of the present invention, a method and apparatus for use in a wellbore are provided to automatically connect a power connector to a means for igniting a propellant within a wireline pressure setting assembly once the wireline pressure setting assembly is lowered downhole within a wellbore. A connector biasing means urges an electrical connection between a first and second connector pins, and an insulator pellet formed from a thermally sensitive material prevents the connector biasing means from urging the electrical connection between the first and second connector pins. The first connector pin is electrically connected to a power connector, and the second connector pin is electrically connected to a means for igniting a solid propellant within the wireline pressure setting assembly. Once the wireline pressure setting assembly is lowered within the wellbore, the insulator pellet is exposed to wellbore temperatures which heat the insulator pellet to an activation temperature, at which the insulator pellet softens and allows the biasing means to urge the electrical connection between the first and second connector pins.

Additional objects, features and advantages will be apparent in the written description which follows.

BRIEF DESCRIPTION OF THE DRAWING

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
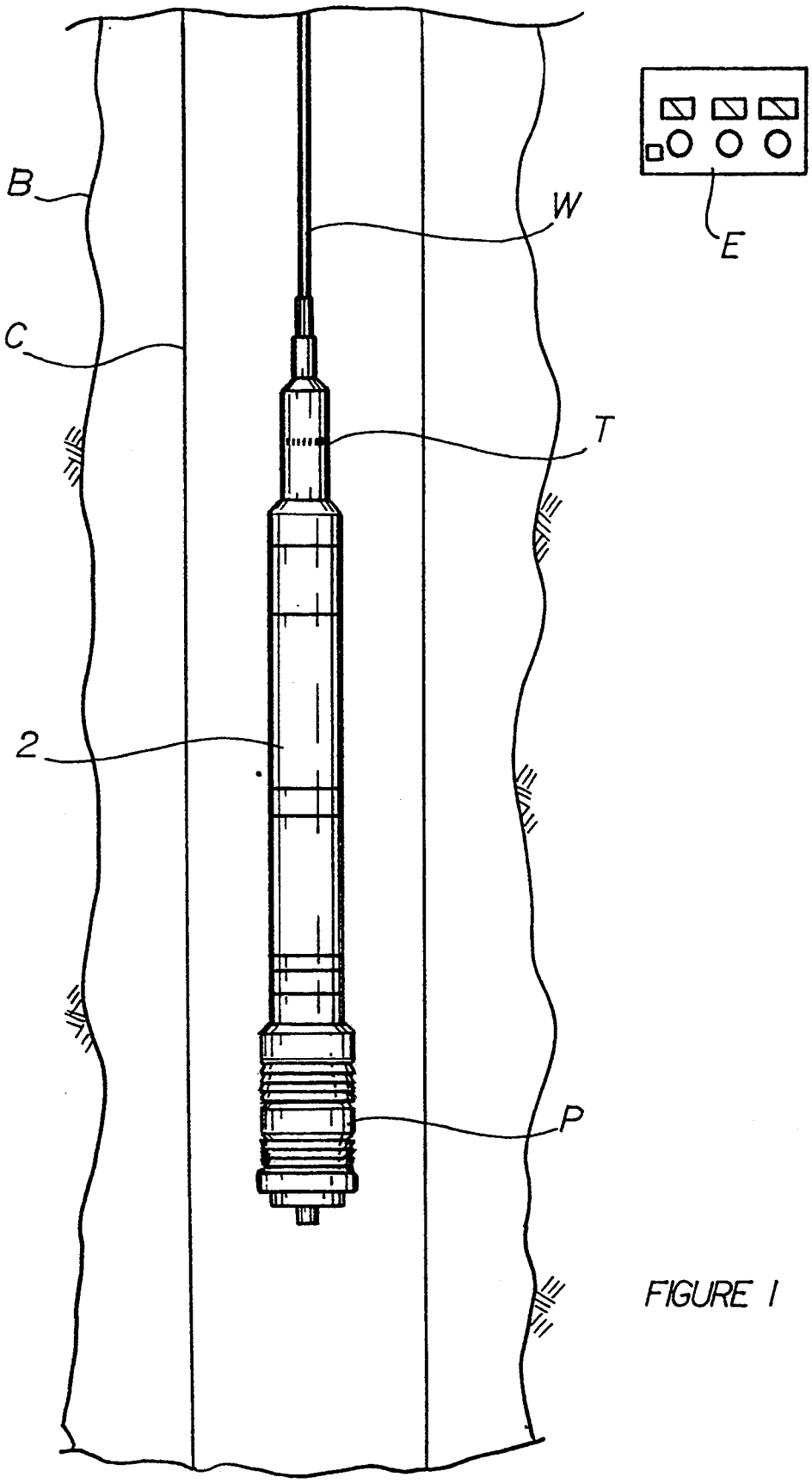
FIG. 1 is a partial longitudinal section view of a wellbore depicting a wireline tool string which includes a wireline pressure setting assembly of the preferred embodiment of the present invention.

Referring to FIG. 1, a partial longitudinal section view depicts wellbore B having casing C within which wireline tool string T is secured to wireline W. Electrical power supply E is schematically shown for providing power to tool string T. Wireline tool string T includes downhole well tool 2 which, in the preferred embodiment of the present invention, is a wireline pressure setting assembly. Tool string T further includes a packer P which is releasably secured to downhole well tool 2 for positioning and setting within casing C.

Figure 2:
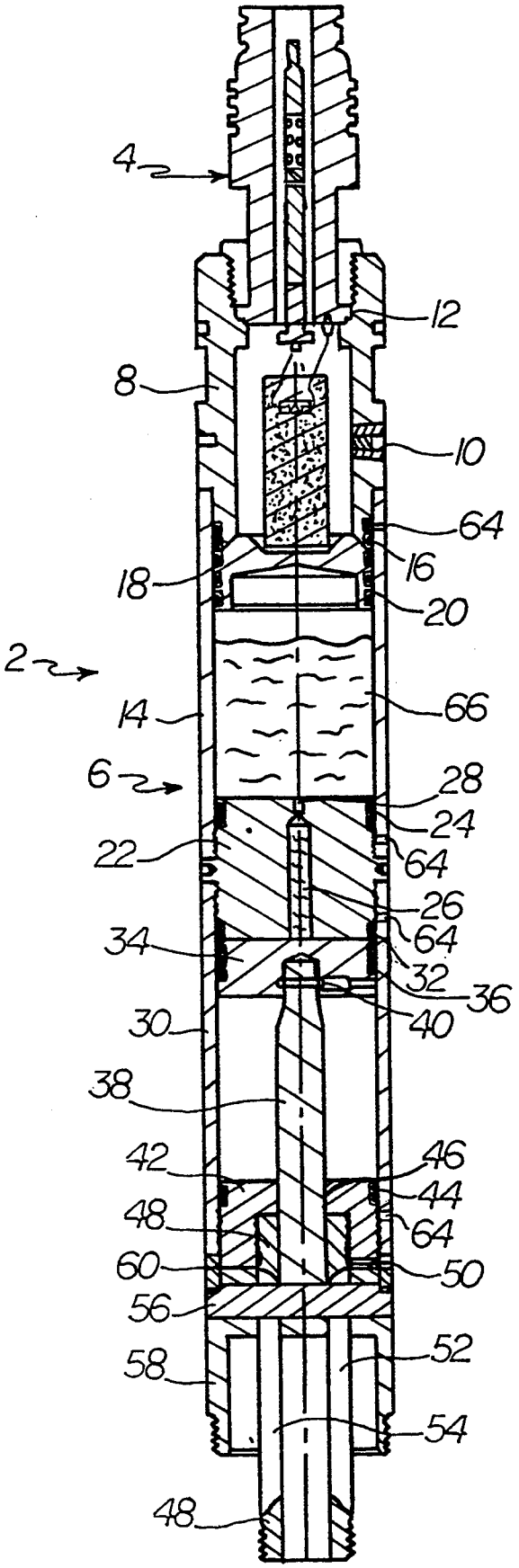
FIG. 2 is a longitudinal section view of a wireline pressure setting assembly of the preferred embodiment of the present invention, shown prior to running downhole within a wellbore and prior to actuation.

With reference to FIG. 2, a longitudinal section view shows downhole well tool 2 prior to running downhole within a wellbore and prior to actuation. In the preferred embodiment of the present invention, downhole well tool 2 is, in general, a wellbore pressure setting assembly, and in particular, downhole well tool 2 is a wireline pressure setting assembly having an elongated tubular body, and including firing head 4 and pressure setting tool 6.

Pressure setting tool 6 includes pressure chamber 8. Pressure chamber 8 includes a manual bleeder valve 10 for bleeding pressure from within pressure chamber 8 after operation of downhole well tool 2. An upper end of pressure chamber 8 threadingly engages firing head 4 and fluid flow therebetween is prevented by seal 12.

Upper cylinder 14 is threadingly coupled to a lower end of pressure chamber 8, and seal 16 prevents fluid flow therebetween. Within upper cylinder 14 is floating piston 18, which is a pressure responsive member. Floating piston 18 is movable within upper cylinder 14 and, during operation of downhole well tool 2, is urged to move downward by gas pressure within pressure chamber 8. Seal 20 prevents fluid flow between an outer circumference of floating piston 18 and an interior diameter of upper cylinder 14.

Cylinder connector 22 is threadingly coupled to a lower end of upper cylinder 14. Seal 24 prevents fluid flow between an outer circumference of an upper end of cylinder connector 22 and an interior of the lower end of upper cylinder 14. Cylindrical connector 22 includes flow port 26 having orifice 28 which substantially measures three-sixteenths of an inch in diameter at an upper end of flow port 26.

Lower cylinder 30 has an upper end which is threadingly coupled to a lower portion of cylindrical connector 22. Seal 32 prevents fluid flow between an outer circumference of the lower end of cylindrical connector 22, and an interior of the upper end of lower cylinder 30.

Secondary piston 34 is disposed interiorly of and is movable within lower cylinder 30. Secondary piston 34 is a second pressure responsive member and is movable within lower cylinder 30. Seal 36 seals between an outer circumference of secondary piston 34 and an interior diameter of lower cylinder 30.

Piston rod 38 is secured to secondary piston 34 by lock pin 40, and is also movable within lower cylinder 30.

Cylinder head 42 is threadingly coupled to the lower end of lower cylinder 30. Seal 44 prevents fluid flow between the outer circumference of cylinder head 42 and the interior diameter of lower cylinder 30. Seal 46 prevents fluid flow between an interior surface of cylinder head 42 and an outer circumference of piston rod 38, which is movable with respect to cylinder head 42 and seal 46.

Mandrel 48 has an upper end which is threadingly secured within cylinder head 42. Set screw 50 prevents rotation of mandrel 48 within cylindrical head 42 after mandrel 48 is threadingly secured within cylindrical head 42. Mandrel 48 includes longitudinally extending slot 52, and longitudinally extending slot 54 which are two diametrically opposed longitudinally extending slots through an outer tubular wall of mandrel 48.

Cross link 56 inserts through longitudinally extending slot 52 and longitudinally extending slot 54, and is movable longitudinally within slots 52 and 54. Cross link 56 further inserts through piston rod 38 and sleeve 58 to couple sleeve 58 to piston rod 38. Cross link retaining ring 60 retains cross link 56 within sleeve 58 to maintain cross link 56 in engagement within sleeve 58 and piston rod 38. Lock screw 62 (not shown) secures cross link retaining ring 60 to sleeve 58.

Sleeve 58 is a driven member which is driven downward by piston rod 38 and cross link 56 when secondary piston 34 is urged into moving downward during operation of downhole well tool 2.

Pressure equalization ports 64 and manual bleeder valve 10 are provided for releasing fluid pressure from within pressure chamber 8, upper cylinder 14, and lower cylinder 30 after operation of downhole well tool 2. Pressure equalization ports 64 are provided at seal 16, seal 24, and seal 44. During disassembly of downhole well tool 2 after operation within wellbore B, thread pressure equalization ports 64 allow release of pressure from within downhole well tool 2 by passing over seal 16, seal 24, and seal 44, respectively, prior to the threaded connections of these seals being completely uncoupled. Thread pressure equalization ports 64 thus allow pressure to be released from the interior of downhole well tool 2 prior to fully uncoupling portions of downhole well tool 2.

Hydraulic fluid 66 is contained between floating piston 18 and secondary piston 34 to provide an intermediate fluidic medium for transferring force between floating piston 18 and secondary piston 34. As shown in FIG. 2, prior to actuating pressure setting tool 6, hydraulic fluid 66 is primarily disposed within upper cylinder 16.

During operation of pressure setting tool 6 to move sleeve 58 with respect to mandrel 48, a gas pressure generated within pressure chamber 8 urges floating piston 18 downward. Downward movement of floating piston 18 presses hydraulic fluid 66 through orifice 28 and flow port 26 to drive secondary piston 34 downward. Movement of secondary piston 34 downward within lower cylinder 30 causes piston rod 38, cross link 56, and sleeve 58 to move downward with respect to lower cylinder 30 and mandrel 48. Firing head 4, pressure chamber 8, upper cylinder 14, cylinder connector 22, lower cylinder 30, cylinder head 42, and mandrel 48 remain stationery as floating piston 18, hydraulic fluid 66, secondary piston 34, piston rod 38, cross link 56, sleeve 58, and cross link retaining ring 60 move within pressure setting tool 6.

Figure 3:
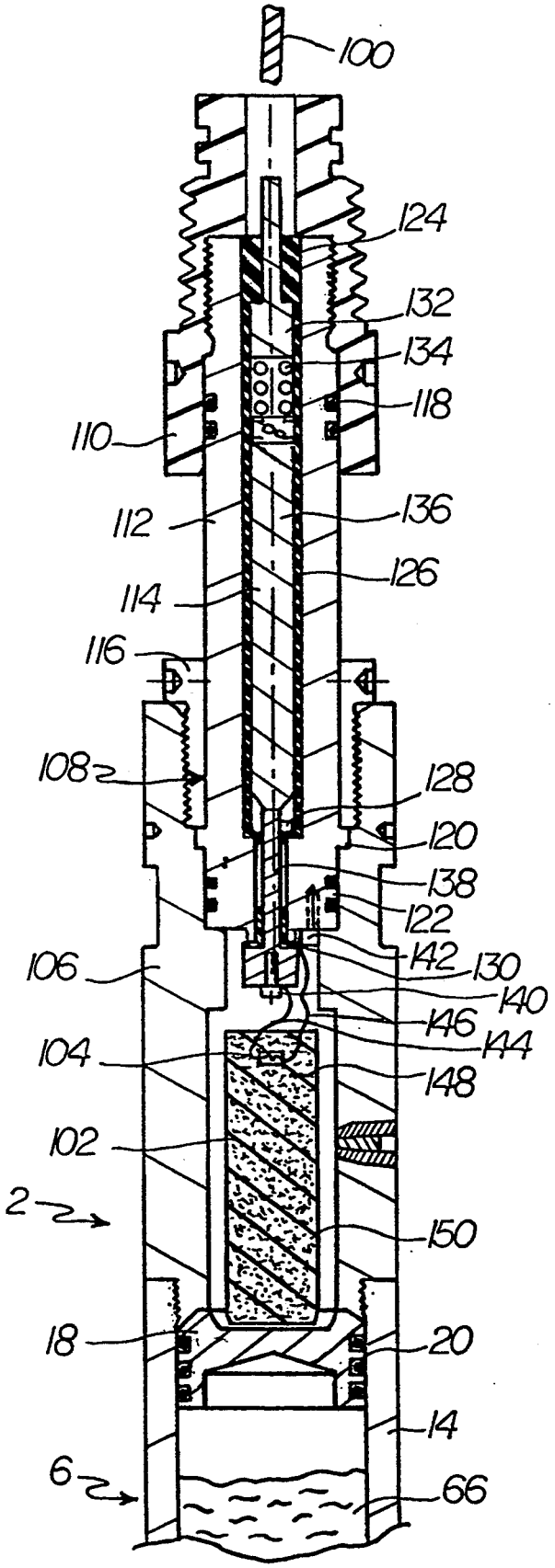
FIG. 3 is a longitudinal section view depicting a firing head and non-explosive igniter of the wireline pressure setting assembly of the preferred embodiment of the present invention.

With reference to FIG. 3, a longitudinal section view depicts a portion of downhole well tool 2 of the preferred embodiment of the present invention. Power conductor 100 electrically connects power supply E (not shown in FIG. 3) to downhole well tool 2. Downhole well tool 2 includes power charge 102 having resistance heater 104. Resistance heater 104 is a means for igniting power charge 102 in the preferred embodiment of the present invention. Downhole well tool 2 further includes pressure setting tool 6 having firing head 4 and pressure chamber 8. Although pressure chamber 8 is used with firing head 4 in the preferred embodiment of the present invention, in other embodiments of the present invention, firing head 4 may be constructed for use with other pressure chambers, such as, for example, pressure chamber 164 (shown in FIG. 5 below).

Still referring to FIG. 3, in the preferred embodiment of the present invention, firing head 4 includes adapter 110, connector housing 112, electrical connector assembly 114, and housing lock ring 116. Connector housing 112 is threadingly engaged within adapter 110. Seal 118 seals between an outer circumference of connector housing 112 and an interior diameter of a lower end of adapter 110. A lower end of connector housing 112 includes shoulder 120 and is secured within pressure chamber 8 by housing lock ring 116 threadingly engaging within an upper end of pressure chamber 106. Housing lock ring 116 abuts against shoulder 120 of connector housing 112 to retain connector housing 112 within pressure chamber 8. Seal 12 prevents fluid flow between an outer circumference of connector housing 112 and an interior diameter of pressure chamber 8.

Electrical connector assembly 114 is electrically connected to power conductor 100, and electrically insulated within connector housing 112 by insulator 124, insulator 126, insulator 128, and insulator 130, which are made from polytetrafluoroethylene, which is available from E. I. DuPont De Nemours and Company under the registered trademark TEFLON®. Electrical connector assembly 114 includes upper connector pin 132, connector spring 134, insulator pellet 135, connector rod 136, and lower connector pin 138. Connector spring 134 is a biasing means which is compressed so that it presses against upper connector pin 132 and insulator pellet 135, which presses connector rod 136 into lower connector pin 138. In other embodiments of the present invention, connector spring 134 may also serve as a biased member which urges itself into a position for passing electrical current between upper connector pin 132, and connector rod 136 and lower connector pin 138. Additionally, some alternative embodiments of the present invention may use other suitable means as a biasing means for urging contact between two conductive members, such as, for example, gravity.

Power lead screw 140 threads into a lower end of lower connector pin 138. Ground lead screw 142 threads into a lower face of connector housing 112. Power lead 144 is connected by power lead screw 140 to electrical connector assembly 114. Ground lead 146 is connected by ground lead screw to connector housing 112 which provides an electrical ground for completing an electrical circuit from wireline tool string T (shown in FIG. 1), through electrical connector assembly 114, to resistance heater 104 within power charge 102, and to ground lead 146.

Power charge 102 of the preferred embodiment of the present invention includes resistance heater 104, chemical components 148, and power charge housing 150. Power lead 144 and ground lead 146 extend from resistance heater 104 through a portion of chemical components 148, and through power charge housing 150 to provide an electrical connection for providing power to resistance heater 104. In the preferred embodiment of the present invention, chemical components 148 serve as a propellant which burn to generate a pressurized gas which urges floating piston 18 downwards.

In the preferred embodiment of the present invention, propellant 148 is made of a standard-service, solid propellant mixture which is the same mixture which is utilized in prior art power charges, such as power charge 170 discussed below for use in an alternative embodiment of the present invention and which is available from Baker Oil Tools Incorporated, a division of Baker Hughes Incorporated, both of Houston, Tex. However, in the preferred embodiment of the present invention, propellant 148 in power charge 102 is directly ignited to burn in a combustion reaction by heat from resistance heater 104, rather than being ignited by either a primary or a secondary igniter burning to generate heat for igniting the prior art propellant in power charge 170.

Prior art primary and secondary igniters typically utilize an explosive mixtures. However, in the preferred embodiment of the present invention, power charge 102 is ignited without use of explosive materials, but rather is directly ignited by heat electrically generated from resistance heater 104. A primary or secondary chemical reaction, such as an explosion, is not utilized.

In the preferred embodiment of the present invention, resistance heater 104 is a 5-watt wire-wound resister which is sealed within chemical components 148 in power charge housing 150. Power charge propellant 148 and resistance heater 104 are packaged into a singular package, or container, power charge housing 150, for storage, transport, and insertion into wellbore tool 100. Propellant 148 is self-contained since it is packaged within the container for power charge 102, which in the preferred embodiment of the present invention is a singular container, power charge housing 150.

Figure 4:
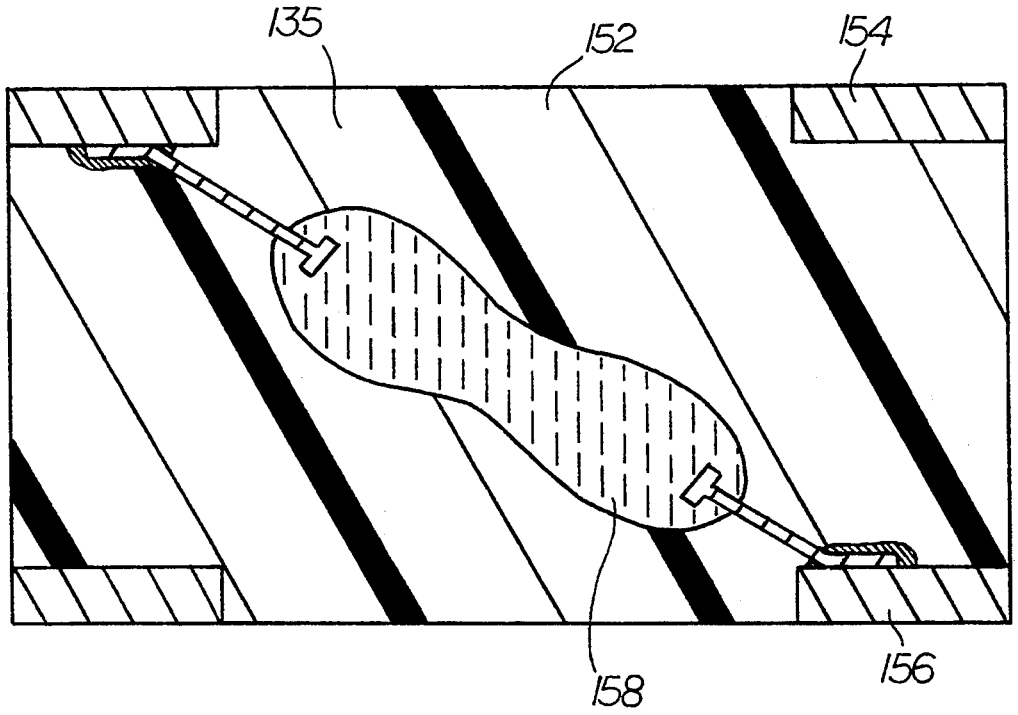
FIG. 4 is a longitudinal section view depicting an insulator pellet which is a temperature sensitive member for use in the preferred embodiment of the present invention.

Referring now to FIG. 4, a longitudinal section view depicts insulator pellet 135 which is used for a temperature sensitive member in the preferred embodiment of the present invention. Insulator pellet 135 includes thermally sensitive material 152 from which a nonconductive portion of insulator pellet 135 is formed. Thermally sensitive material 152 may be a nonconductive material which, when heated to an activation temperature which is higher than the highest ambient temperatures expected to be found at the ground level above the wellbore, will soften, or melt, to let a biased member, such as, for example, connector spring 134, pass through non-conductive thermally sensitive material 152 in insulator pellet 135. Insulator pellet 135 may be made from such materials as, mixtures of paraffin wax, such as from which candles are made, or, for another example, hot glue such as that found for use in commercially available hot glue guns, which will soften, or melt, at selectable temperatures, such as 120° Fahrenheit, to release a biased conductive member.

Insulator pellet 135 further includes electrical contacts 154 and 156, and tester fuse 158, which has leads which are soldered to electrical contacts 154 and 156. In the preferred embodiment of the present invention, electrical contacts 154 and 156 are each metal washers, and electrical contact 154 is a biased member, which is biased by connector spring 134 (not shown in FIG. 4).

Different materials may be selected to form insulator pellet 135 for selecting the activation temperature. For example, an insulator pellet formed from a hot glue sold under a product name of "Swingline® Glue Sticks for Electric Glue Gun," available from Swingline® Inc., of Long Island City, N.Y., having product number 96850, and part number 7471196850, was tested and found to activate at 150° Fahrenheit, at which temperature it softened to allow connector spring 134 to urge electrical contact between electrical contacts 154 and 156.

In the preferred embodiment of the present invention, tester fuse 158 allows equipment electrical continuity checks to be performed for assuring proper assembly of components with which insulator pellet 135 is assembled for wellsite operations, and separates when exposed to a predetermined level of electrical current to prevent sufficient current from passing to electrical resistance heater 104 for igniting power charge 102 prior to heating insulator pellet 135 to the activation temperature. In the preferred embodiment of the present invention, tester fuse 158 may be, for example, a $\frac{1}{8}$ ampere electrical fuse which allows less than $\frac{1}{8}$ amperes of electrical current to pass therethrough to prevent ignition.

For use with explosive materials in an alternative embodiment of the present invention, an amperage rating of fuse 158 should be chosen to blow, or separate fuse 158, prior to passing enough current for ignition of the explosive material, and to allow electrical continuity checks to be performed during operations within which heat activated safety fuse 158 is utilized.

In the preferred embodiment of the present invention, tester fuse 158 is positioned diagonally between electrical contacts 154 and 156, to which it is soldered. For use with a downhole well tool 2, having a wireline pressure setting assembly and a non-explosive power charge igniter, tester fuse 158 is a $\frac{1}{8}$ ampere fuse manufactured by Littelfuse, Inc., which is a very fast acting fuse, available from Newark Electronics in Chicago, Ill., and further identified as a PICO II, type 251.125.

It should be noted that in some alternative embodiments of the present invention, a thermally sensitive member may be provided which does not include tester fuse 158, and electrical contacts 154 and 156, but, for example, may only include thermally sensitive material 152. In other embodiments of the present invention, insulator pellet 135 may hold a biased member in place until the activation temperature is reached, and then release the biased member which, rather than connecting between two conductive members for passing a current, urges electrical contact between the two conductive members, or even releases a grounding connection which shunts power conductor 100 to ground for preventing current from passing through resistance heater 104. Additionally, biasing means may be used other than the spring biasing means of connector spring 134, such as, for example, gravity may be utilized as a biasing means.

Figure 5:
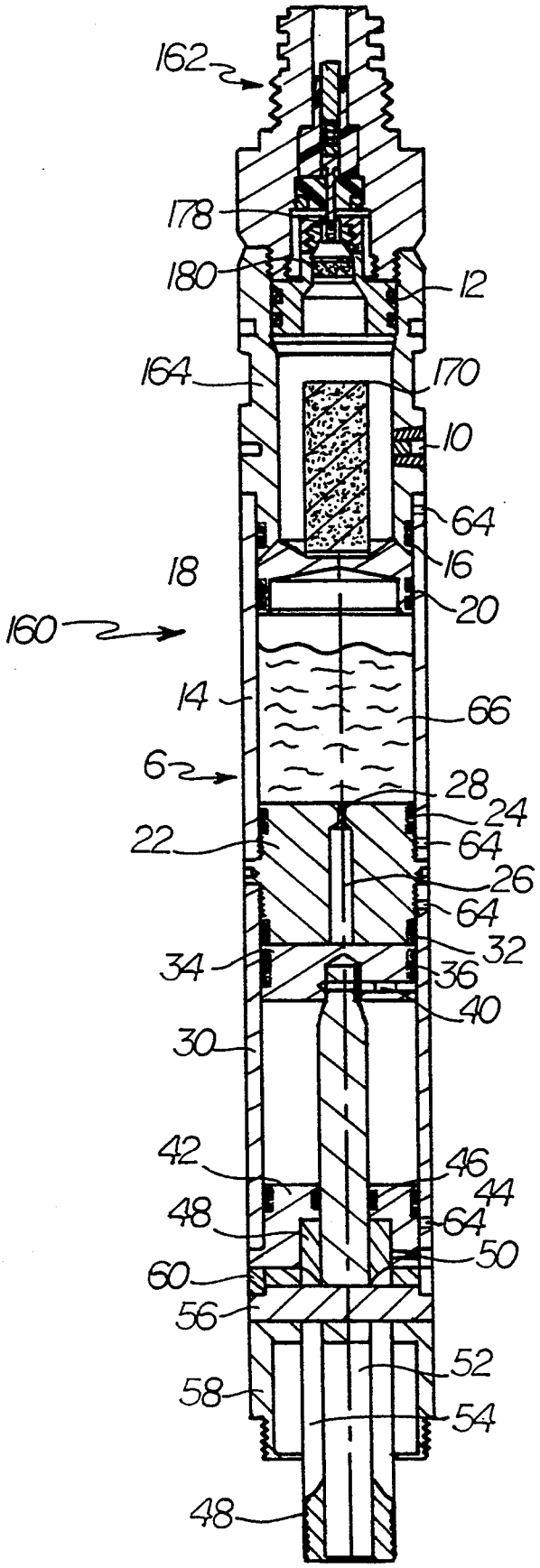
FIG. 5 is a longitudinal section view of a wireline pressure setting assembly of an alternative embodiment of the present invention, shown prior to running downhole within a wellbore and prior to actuation.

Referring to FIG. 5, a longitudinal section view depicts an alternative embodiment of the present invention, downhole well tool 160, which may be run within tool string T of FIG. 1 in place of downhole well tool 2. Downhole well tool 160 is similar to downhole well tool 2 of FIG. 2, except that firing head 162 is used in place of firing head 4, and pressure chamber 164 is used to accommodate firing head 162, rather than pressure chamber 8 which accommodates firing head 4. In fact, the above description of the components for downhole well tool 2 may be referenced for the components of downhole well tool 160, except for firing head 162 and pressure chamber 164 accepting firing head 162 rather than firing head 4. Additionally, FIG. 1 may also be referenced to in reference to downhole well tool 160, although FIG. 1 depicts downhole well tool 2.

Still referring to FIG. 5, power charge 170 is shown disposed within pressure chamber 164 of downhole well tool 160 prior to actuation for providing pressure to urge floating piston 18 downwards within upper cylinder 14. In this alternative embodiment of the present invention, chemical components within power charge 170 serve as a propellant which burn to generate a gas having a pressure which urges floating piston 18 downwards. Power charge 170 is self-contained since it is packaged within a singular container.

Figure 6:
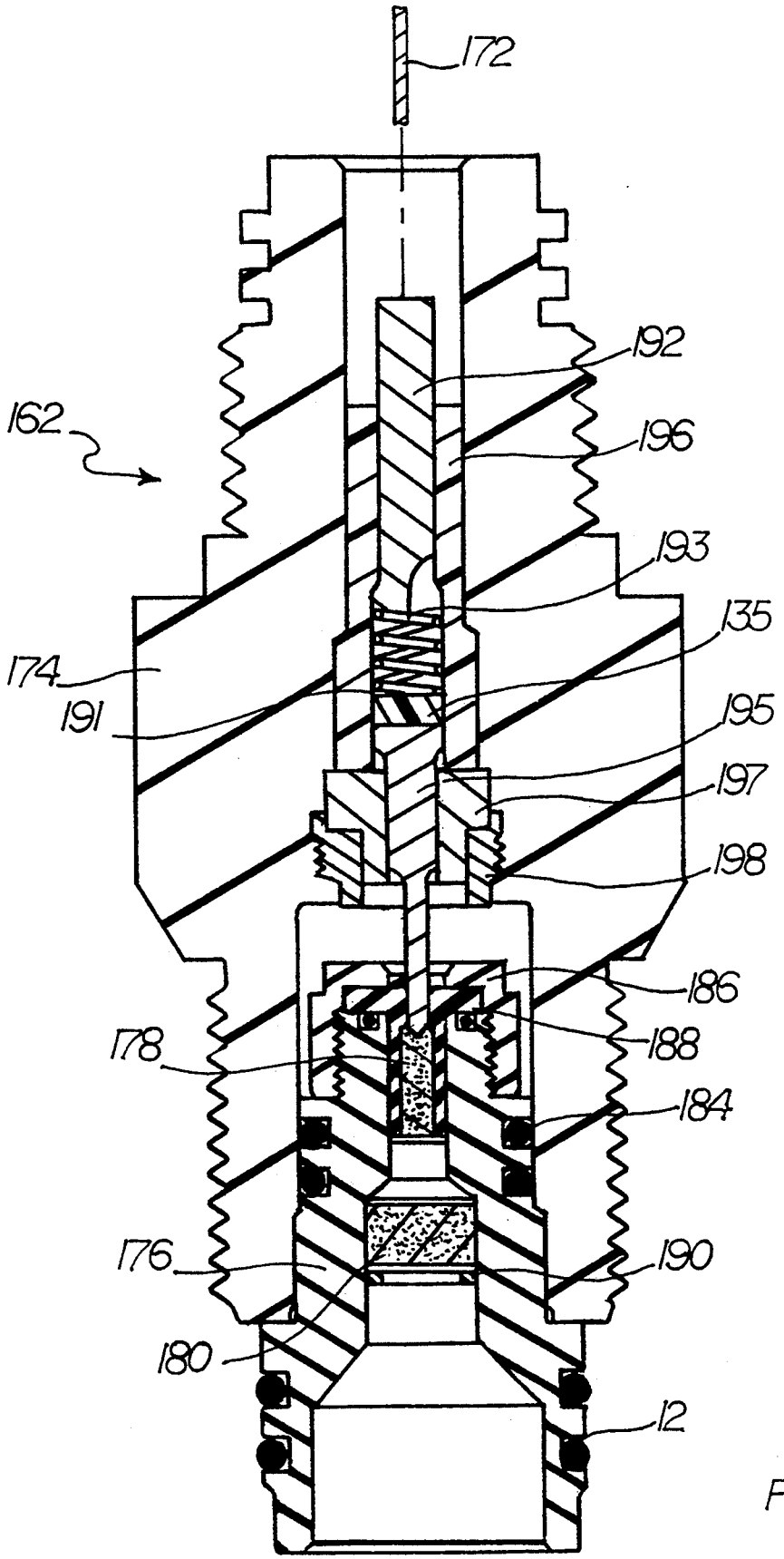
FIG.6 is a longitudinal section view depicting a portion of the wireline pressure setting assembly of the alternative embodiment of the present invention of FIG. 5.

Referring now to FIG. 6, a longitudinal section view of a portion of the wireline pressure setting assembly of the alternative embodiment of the present invention depicted in FIG. 5, downhole well tool 160, depicts firing head 162. Firing head 162 threadingly secures to the upper end of alternative pressure chamber 164, (not shown in FIG. 6), and is sealed by seal 12 as discussed above. Alternative pressure chamber 164 is similar to pressure chamber 8, except adapted for receipt of firing head 162 rather than firing head 4. Firing head 162 is electrically connected to power supply E (not shown in FIG. 6) by, in part, power conductor 172. Firing head 162 includes connector housing 174, and igniter housing 176.

Igniter housing 176 houses primary igniter 178, such as, for example, a BP3A primary igniter, and further houses secondary igniter 180. Primary igniter 178, secondary igniter 180, and power charge 170, are manufactured by and available from Baker Oil Tools Incorporated, a division of Baker Hughes Incorporated, both of Houston, Tex. In the preferred embodiment of the present invention, primary igniter 178 and secondary igniter 180 include explosive materials for igniting power charge 170.

Still referring to FIG. 6, an upper end of connector housing 174 is threaded for connection to a wireline tool string (not shown in FIG. 6). A lower end of connector housing 174 threadingly engages an upper end of pressure chamber 164 (not shown in FIG. 6). Igniter housing 176 is threadingly coupled within the lower end of connector housing 174 by a left-hand threaded connection. Seal 12 sealingly engages between an outer circumference of igniter housing 176 and an interior diameter of pressure chamber 164 to prevent fluid flow therebetween. Seal 184 sealingly engages between an outer circumference of igniter housing 176 and an interior diameter of the lower end of connector housing 174 to prevent fluid flow therebetween.

Cartridge cap 186 retains primary igniter 178 within an upper end of igniter housing 176. Seal 188 sealingly engages between cartridge cap 186 and primary igniter housing 176. Secondary igniter 180 is held within igniter housing 176 by snap ring 190.

Electrical connector assembly 191 is utilized to electrically connect a wireline, or wireline tool string, to primary igniter 178. Electrical connector assembly 191 includes upper connector pin 192, connector spring 193, insulator pellet 135, and lower connector pin 195. Electrical connector assembly 191 is insulated by insulator sleeve 196 and pin insulator 197 to prevent electrical continuity between connector housing 174 and electrical connector assembly 191. Insulator sleeve 196 and pin insulator 197 are made from suitable insulating materials, such as, for example, polytetrafluoroethylene, which is available from E. I. DuPont De Nemours and Company under the registered trademark TEFLON ®. Connector lock ring 198 threadingly engages within connector housing 174 to hold insulator sleeve 196, pin insulator 197, and electrical connector assembly 191 in place within connector housing 174.

Connector spring 193 is a biasing member which, in this alternative embodiment of the present invention, pushes against both upper connector pin 192, and insulator pellet 135 prior to insulator pellet 135 being raised to an activation temperature. Connector spring 193 also urges upper connector pin 192 upwards and lower connector pin 195 downward and into electrical contact with the upper end of primary igniter 178. In some embodiments of the present invention, connector spring 193 may not only serve as a biasing means, but may itself serve as a biased member for urging into a position for passing electrical current between power supply E (shown in FIG. 1) and downhole well tool 160 (shown in FIG. 5).

Still referring to FIG. 6, it should be noted, that although insulator pellet 135 is disposed between connector spring 193 and lower connector pin 195 in this alternative embodiment of the present invention, in other embodiments of the present invention, insulator pellet 135 may be disposed in alternative positions, such as, for example, at cartridge cap 186 to prevent lower connector pin 195 from making electrical contact with primary igniter 178 until after insulator pellet 135 is lowered within a wellbore and raised to an activation temperature by temperatures higher than the activation temperature found within the wellbore.

Operation of downhole well tools 2 and 160 is now discussed with reference to Figures, beginning now with downhole well tool 2 and referring to FIGS. 3 and 4. Upon lowering downhole within the wellbore, insulator pellet 135 is exposed to temperatures within the surrounding wellbore which raise the temperature of insulator pellet 135 to an activation temperature, which in the preferred embodiment of the present invention is substantially not less than 120° Fahrenheit. As insulator pellet 135 reaches the activation temperature, thermally sensitive material 152 softens, to allow connector spring 134, which is compressed, to pass through insulator pellet 135, pushing electrical contact 154 into electrical contact with electrical contact 156. In some embodiments of the present invention, thermally sensitive material 102 within insulator pellet 135 may melt to become a liquid. Additionally, in alternative embodiments of the present invention which do not include electrical contacts 154 and 156, connector spring 134 may pass through insulator pellet 135 and contact connector rod 136 for passing electrical current therethrough to lower connector pin 138.

Once insulator pellet 135 is heated to the activation temperature and softens, connector spring 134 pushes electrical contact 154 through insulator pellet 135 and into electrical contact with electrical contact 156 to electrically connect between upper connector pin 132 and connector rod 136, which is electrically connected to lower connector pin 138. Electrical connector assembly 114 then electrically connects between power supply E (not shown in FIG. 3) and resistance heater 104. Resistance heater 104 can now be selectively operated once downhole well tool 2 is lowered to a selected position within wellbore B for setting packer P.

Referring to FIGS. 1, 2 and 3, which depict the preferred embodiment of the present invention prior to activation of insulator pellet 135 and prior to operation of downhole well tool 2, electrical power is then selectively applied from electrical power supply E, through wireline W, and to wireline tool string T. Electrical power then passes from wireline tool string T, through power conductor 100, electrical conductor assembly 114, power lead screw 140, and power lead 144 to resistance heater 104. The electrical circuit is completed by ground lead 146 which is affixed by ground lead screw 142 to conductor housing 112.

Approximately five to ten times the wattage rating for resistance heater 104 is passed through resistance heater 104. Resistance heater 104 generates heat which then directly ignites chemical components 148, without use of a primary or a secondary igniter, or explosive materials. Ignition of chemical components 148 causes them to burn in a self-sustained combustion reaction and a pressurized gas is generated. The pressure of the pressurized gas then builds within pressure chamber 106 to urge floating piston 18 downward.

Movement of floating piston 18 downward pushes hydraulic fluid 66 through orifice 28 and flow port 26 to push secondary piston 34 downward. Secondary piston 34 is connected to piston rod 38, cross link 56, and sleeve 58. Movement of secondary piston 34 downward within lower cylinder 30 moves sleeve 58 downward with respect to mandrel 48. Relative movement of sleeve 58 with respect to mandrel 48 is applied to a downhole tool, such as packer P, for applying a force over a distance to set packer P within casing C. (Packer P not shown in a set position.)

Referring to the alternative embodiment of the present invention which is depicted in FIGS. 4, 5 and 6, insulator pellet 135 is depicted prior to activation and downhole well tool 160 is depicted prior to operation. Once insulator pellet 135 is heated to the activation temperature at which it softens, connector spring 193, which is compressed, pushes electrical contact 154 through insulator pellet 135 and makes electrical contact with electrical contact 156 to provide an electrical connection between upper connector pin 192 and lower connector pin 195. Electrical connector assembly 191 then connects from power supply E (not shown in FIGS. 4, 5 and 6), through power conductor 172, into primary igniter 178. Primary igniter 178 can now be ignited once downhole well tool 160 is lowered to a selected position within wellbore B for setting packer P (shown in FIG. 1 prior to setting).

Referring to FIGS. 1, 5 and 6, electrical power is then selectively applied from electrical power supply E, through wireline W, and to wireline tool string T. When the downhole well tool 160 is disposed within tool string T rather than downhole well tool 2, electrical power passes within wireline tool string T, and through, referring back to FIG. 6, power conductor 172 and electrical connector assembly 191, and to primary igniter 178. The electrical circuit is completed by primary igniter 178 contacting connector housing 174. Connector housing 174 and igniter housing 176 provide an electrical ground for completing an electrical circuit between power conductor 172 and primary igniter 178 and power supply E.

Still referring to FIGS. 5 and 6, power charge 170 is ignited by passing electrical current from an electrical power supply, such power supply E, and through a wireline W to a wireline tool string T, through electrical connector assembly 191, and to primary igniter 178. Primary igniter 178 includes a gunpowder load which is ignited by the electrical current conducted through electrical connector assembly 191. Primary igniter 178 burns to generate heat which ignites secondary igniter 180. Referring to FIG. 5, secondary igniter 180 burns and generates heat which then ignites chemical components 171 within power charge 170. Power charge 170 then burns in a self-sustained combustion reaction to generate a gas, having a pressure which pushes floating piston 18 downward.

Still referring to the alternative embodiment of the present invention depicted in FIGS. 5 and 6, power charge 170 will burn in a self-sustained chemical reaction, which, in the preferred embodiment of the present invention, is a combustion reaction for generating gas. The combustion reaction of the preferred embodiment is a slow combustion reaction, burning at a rate so that a maximum level of gas pressure within pressure chamber 164 will not be reached before a one second period of time has elapsed. This is to be distinguished from explosive reactions in which explosive material is either detonated, deflagrated, or generally burns with a rate of reaction which takes no more than a time period of several milliseconds to burn the explosive materials.

Referring to FIG. 5, movement of floating piston 18 downward pushes hydraulic fluid 66 through orifice 28 and flow port 26 to push secondary piston 34 downward. Secondary piston 34 is connected to piston rod 38, cross link 56, and sleeve 58. Movement of secondary piston 34 downward within lower cylinder 30 moves sleeve 58 downward with respect to mandrel 48. Relative movement of sleeve 58 with respect to mandrel 48 is applied to a downhole tool, such as, referring back to FIG. 1, packer P, for applying a force over a distance to set packer P within casing C. (Packer P not shown in a set position.)

The present invention offers several advantages over prior art setting tools. One advantage is that electrical power cannot be applied between a power supply and an electrically operated downhole well tool until after the tool string is lowered downhole within the wellbore to sufficient wellbore depths having high enough temperatures to heat an insulator pellet to an activation temperature at which the insulator pellet softens, or melts, to allow the connector spring to push therethrough.

Further, the present invention provides a downhole well tool for automatically connecting an electrically operated downhole well tool to a power conductor only after the electrically operated downhole well tool is lowered downhole within the wellbore.

Additionally, the present invention provides a low cost method and apparatus for preventing actuation of a downhole well tool prior to running the downhole well tool downhole within a wellbore.

Although the downhole well tool of the present invention has been described herein embodied for use in a wireline conveyed pressure setting assembly, other embodiments of the present invention may be for use in other types of wellbore pressure setting assemblies, such as, for example, a tubing convened pressure setting assembly, and thus is not limited to wireline conveyed pressure setting assemblies, nor tubing conveyed pressure setting assemblies. Additionally, alternative embodiments of the downhole well tool of the present invention may include perforating guns, such as those for conveying and actuating explosive shaped charges, and downhole well tools not using explosives or pyrotechnic materials. The downhole well tool of the present invention is thus not limited to use with either pyrotechnic, or explosive actuators. While the invention has been shown in only one of its forms, it is thus not limited but is susceptible to various changes and modifications without departing from the spirit thereof.

What is claimed is:

1. An apparatus for use in a wellbore to prevent an electrical current from passing between a power supply and an electrically operated downhole well tool until after said apparatus is positioned downhole within said wellbore, said apparatus comprising:

a housing for lowering within said wellbore secured within a tool string;

a plurality of electrically conductive members for providing an electrical circuit between said power supply and said electrically operated downhole well tool, and a portion of which are secured about said housing for lowering within said wellbore;

a plurality of seals for hydraulically sealing at least a portion of said plurality of electrically conductive members from a fluid within said wellbore;

at least one insulator for electrically insulating at least several of said plurality of electrically conductive members from said housing;

a biased member which is secured about said housing for lowering within said wellbore, and which is urged from a first position for preventing said electrical current from passing between said power supply and said electrically operated downhole well tool to a second position for allowing said electrical current to pass between said power supply and said electrically operated downhole well tool; and a temperature sensitive member which prevents said biased member from passing from said first position to said second position prior to being heated to an activation temperature, at which said temperature sensitive member softens to allow said biased member to move from said first position to said second position for passing said electrical current through said plurality of electrically conductive members.

2. The apparatus of claim 1, wherein said temperature sensitive member a thermally sensitive material which melts when heated to substantially said activation temperature.

3. The apparatus of claim 1, wherein said activation temperature for said temperature sensitive member is substantially not less than 120 degrees Fahrenheit.

4. The apparatus of claim 1, wherein said biased member is spring biased.

5. The apparatus of claim 1, wherein said biased member is elastically compressed when disposed in said first position, and exerts a force which urges said biased member to move from said first position to said second position upon said temperature sensitive member being heated to said activation temperature.

6. The apparatus of claim 1, wherein said biased member is an electrically conductive member included within said temperature sensitive member, and said apparatus further comprises:

a biasing means, which is a separate member from said biased member for urging said biased member from said first position to said second position.

7. The apparatus of claim 1, wherein said biased member, when urged to said second position, urges at least two of said plurality of said electrically conductive members to electrically connect for passing said electrical current therethrough.

8. The apparatus of claim 7, wherein said biased member is an electrically conductive member, which physically connects between said at least two of said plurality of electrically conductive members for passing said electrical current therethrough.

9. The apparatus of claim 1, wherein said electrically operated downhole well tool includes a pyrotechnic igniter for igniting a power charge within a wellbore pressure setting assembly.

10. The apparatus of claim 1, wherein said temperature sensitive member is heated to said activation temperature by exposure to a plurality of wellbore temperatures which are above a mean expected ambient temperature of a ground surface level above said wellbore.

11. The apparatus of claim 1, further comprising:

said electrically operated downhole well tool, which includes a wellbore pressure setting assembly; and a settable downhole well tool for lowering within said wellbore secured to said wellbore pressure setting assembly, which is operated to urge said settable downhole well tool into a setting engagement within said wellbore.

12. An apparatus for use in a wellbore to automatically complete an electrical circuit for passing an electrical current between a power supply and an electrically operated downhole well tool after said electrically operated downhole well tool is lowered downhole within said wellbore, said apparatus comprising:

a housing for lowering within said wellbore secured within a tool string;

a biased member which is electrically conductive and urged to electrically connect between said power supply and said electrically operated downhole well tool for completing said electrical circuit to pass said electric current therebetween;

said biased member sealed and secured about said housing for lowering within said wellbore protected from a wellbore fluid, and electrically insulated from contacting said housing along at least one electrical pathway for at least a portion of a period of time when disposed within said wellbore; and a temperature sensitive member which prevents said biased member from electrically connecting between said power supply and said electrically operated downhole well tool prior to being heated within said wellbore to an activation temperature, at which said temperature sensitive member softens to allow said biased member to pass therethrough and electrically connect said power supply to said electrically operated downhole well tool for completing said electrical circuit for passing said electrical current therethrough.

13. The apparatus of claim 12 further comprising:

a plurality of electrically conductive members sealed and secured about said housing for lowering within said wellbore protected from a wellbore fluid, and at least a portion of said plurality of electrically conductive members electrically insulated from contacting said housing; and said biased member extending to press between and electrically contact two of said plurality of electrically conductive members to electrically connect between said power supply and said electrically operated downhole well tool after said apparatus is lowered downhole within said wellbore.

14. The apparatus of claim 12, wherein said electrical current is selectively passed after said power supply is electrically connected to said electrically operated downhole well tool.

15. The apparatus of claim 12, further comprising:

said electrically operated downhole well tool.

16. The apparatus of claim 12, further comprising:

said electrically operated downhole well tool, which includes a wellbore pressure setting assembly; and a settable downhole well tool for lowering within said wellbore secured to said wellbore pressure setting assembly, which is operated to urge said settable downhole well tool into a setting engagement within said wellbore.

17. An apparatus for use in a wellbore to automatically connect between a power connector and a means for igniting a propellant within a wellbore pressure setting assembly once said wellbore pressure setting assembly is lowered downhole within said wellbore, said apparatus comprising:

a tubular member having a first and second end for sealingly securing said tubular member within a tool string, said tubular member further including a longitudinally extending bore for passing a connector assembly therethrough;

a first conductive member passing interiorly of said tubular member for electrically connecting to said power connector and forming a portion of said connector assembly;

a second conductive member passing interiorly of said tubular member for electrically connecting to said means for igniting said propellant and forming a portion of said connector assembly;

a biasing means for urging an electrical connection between said power connector and said means for igniting said propellant, said biasing means forming a portion of said connector assembly;

at least one insulator member for electrically insulating between said tubular member and said connector assembly; and a thermally sensitive member which prevents said biasing means from urging said electrical connection prior to said thermally sensitive member being heated to an activation temperature by exposure to a plurality of wellbore temperatures, and, when heated to said activation temperature, said thermally sensitive member softens to allow said biasing means to urge at least a portion of said connector assembly therethrough which connects said power connector to said means for igniting said propellant for passing an electrical current therebetween.

18. The apparatus of claim 17, further comprising:

said wellbore pressure setting assembly.

19. The apparatus of claim 17, further comprising:

a settable downhole well tool for lowering within said wellbore secured to said wellbore pressure setting assembly, which is operated to urge said settable downhole well tool into a setting engagement within said wellbore.

20. The apparatus of claim 17, further comprising:

an electrical connector which is included within said thermally sensitive member, and which forms a portion of said connector assembly for urging to electrically connect between said power connector and said means for igniting said propellant for passing said electrical current therebetween.

21. The apparatus of claim 17, further comprising:

a tester member for electrically connecting across said thermally sensitive member for testing to assure proper assembly of said apparatus prior to lowering said apparatus within said wellbore.

22. An apparatus for use in a wellbore to automatically connect a power connector to a means for igniting a propellant within a wireline pressure setting assembly once said wireline pressure setting assembly is lowered downhole within said wellbore, said apparatus comprising:

a pressure chamber within which said propellant is selectively initiated to interact in a slow chemical reaction for generating a gas having a pressure;

a power charge within which said propellant is included, said propellant made from a plurality of chemical components which are selectively initiated within said pressure chamber to interact in a slow chemical reaction which generates said gas having said pressure, said slow chemical reaction for generating said gas taking at least one second to generate a maximum level of said pressure within said downhole well tool;

said means for igniting said propellant, wherein said means is selectively actuated for converting an electrical energy into heat to initiate said chemical reaction for generating said gas having said pressure;

an electrical power supply and electrical connector for transmitting said electrical current to provide said electrical energy to said means for igniting said power charge;

a pressure responsive member which is selectively moved by said gas having said pressure pushing against said pressure responsive member with at least part of said force to urge a volumetric expansion within a volume which includes, at least in part, said pressure chamber;

a driven member to which said pressure responsive member is connected for transferring from said pressure at least part of said force over at least part of said distance;

a settable downhole well tool which is urged by said driver member into a gripping and sealing engagement within said wellbore;

a tubular member having a first and second threaded ends for sealingly securing said tubular member within a tool string, which includes said wireline pressure setting assembly;

a bore extending longitudinally through said tubular member;

at least one insulator sleeve made from an electrically nonconductive material, and extending longitudinally within said bore of said tubular member;

a first connector pin extending longitudinally and concentrically within said at least one insulator sleeve and said bore, and said first connector pin electrically connected to said power connector for passing an electrical current therebetween;

a second connector pin extending longitudinally and concentrically within said at least one insulator sleeve and said bore, said second connector pin electrically connected to said means for igniting said propellant within said setting tool for passing said electrical current therebetween;

a connector biasing means disposed within said bore of said tubular member for urging an electrical connection between said first and second connector pins for passing said electrical current therebetween;

an insulator pellet formed from a temperature sensitive material which, when at a first temperature substantially below a predetermined temperature, will remain hard to prevent said biasing means from urging said electrical connection, and which when at a second temperature which is substantially equal to or above said predetermined temperature, will automatically soften to allow said biasing means to urge said electrical connection between said first and second connector pins; and wherein said predetermined temperature is a downhole wellbore temperature which is substantially above a maximum expected ambient ground level temperature above said wellbore.

23. An apparatus for use in a wellbore to prevent an electrical current from passing between a power supply and an electrically operated downhole well tool until after said apparatus is lowered downhole within said wellbore, said apparatus comprising:

a temperature sensitive member formed from a thermally sensitive material for securing between said power supply and said electrically operated downhole well tool to prevent said electrical current from passing therebetween;

a first electrical contact secured to a first end of said temperature sensitive member for electrically connecting to said power supply prior to lowering said apparatus within said wellbore;

a second electrical contact secured to a second end of said temperature sensitive member for electrically connecting to said electrically operated downhole well tool prior to lowering said apparatus within said wellbore; and wherein said apparatus is lowered downhole within said wellbore with said electrically operated downhole well tool, preventing said electrical current from passing between said power supply and said downhole well tool, until said apparatus is disposed downhole within said wellbore and said temperature sensitive member is heated to a predetermined temperature, at which said thermally sensitive member softens to allow at least one of said first and second electrical contacts to pass therethrough and provide a conductive pathway for passing said electrical current between said power supply and said electrically operated downhole well tool.

24. The apparatus of claim 23, further comprising:

a tester member secured between said first and second electrical contacts for providing a testing conductive pathway to test for proper assembly of said apparatus with said downhole well tool prior to lowering said apparatus and said downhole well tool within said wellbore.

25. The apparatus of claim 24, wherein said tester member will prevent passage of an electrical current therethrough which exceeds a predetermined current level.

26. The apparatus of claim 25, wherein said tester member includes a fusible portion which separates when an electrical current passing therethrough exceeds said predetermined current level.

27. The apparatus of claim 23, wherein said temperature sensitive member is heated to said predetermined temperature, at which said thermally sensitive material softens, by exposure to at least one downhole temperature which exceeds said predetermined temperature.

28. The apparatus of claim 23, further comprising:

a wellbore pressure setting assembly which included within said electrically operated downhole well tool.

29. The apparatus of claim 23, further comprising:

a settable downhole well tool for securing to said wellbore pressure setting assembly and lowering downhole within said wellbore to a setting depth, at which said electrically operated downhole well tool is operated for urging said downhole well tool into a setting engagement within said wellbore.

30. A method for electrically connecting between a power supply and an electrically operated downhole well tool to complete at least a portion of an electrical circuit therebetween after said electrically operated downhole well tool is lowered downhole with a wellbore, said method comprising the steps of:

securing a biased member about a housing in a first position, from which said biased member is urged to move to a second position to automatically complete said at least a portion of said electrical circuit;

disposing a temperature sensitive member about said biased member to prevent said biased member from moving from said first position to said second position;

including said housing within a downhole well tool string, and sealing said biased member from exposure to wellbore fluids;

lowering said housing downhole within said wellbore, exposing said temperature sensitive member to a plurality of wellbore temperatures which heat said temperature sensitive member to an activation temperature at which said temperature sensitive member softens to allow said biased member to pass therethrough and into said second position; and wherein said biased member moving to said second position automatically electrically connects said power supply and said electrically operated downhole well tool to complete said at least a portion of said electrical circuit for passing an electrical current therethrough.

31. The method of claim 30, wherein said biased member is urged to move to said second position by a spring bias.

32. The method of claim 30, further comprising the step of:

forming said temperature sensitive member from a thermally sensitive material which melts when heated to substantially said activation temperature.

33. The method of claim 30, wherein said electrical current is selectively applied to pass through said at least a portion of said electrical circuit, and between said power supply and said electrically operated downhole well tool, independently of said biased member moving from said first position to said second position once said biased member moves to said second position.

34. The method of claim 30, wherein said biased member includes a conductive portion which, when said biased member is in said second position, electrically connects said power connector to said electrically operated downhole well tool by providing a conductive pathway for electrical current to pass therebetween.

35. The method of claim 30, wherein said electrically operated downhole well tool is a wireline pressure setting assembly having a pyrotechnic device which said electrical current ignites to initiate actuation of said wireline pressure setting assembly.

36. A method for electrically connecting between a power supply and a wireline pressure setting assembly to complete at least a portion of an electrical circuit therebetween after said wireline pressure setting assembly is lowered downhole within a wellbore, said method comprising the steps of:

securing a biased member about a housing in a first position, from which said biased member is urged to move to a second position to automatically complete said at least a portion of said electrical circuit;

disposing a temperature sensitive member about said biased member to prevent said biased member from moving from said first position to said second position;

including said housing within a downhole well tool string which includes said wireline pressure setting assembly, and sealing said biased member from exposure to wellbore fluids;

lowering said housing downhole within said wellbore, and thus exposing said temperature sensitive member to a plurality of wellbore temperatures which heat said temperature sensitive member to an activation temperature at which said temperature sensitive member softens to allow said biased member to pass therethrough and into said second position; and wherein said biased member moving to said second position automatically electrically connects between said power supply and said wireline pressure setting assembly to complete said at least a portion of said electrical circuit for passing an electrical current therethrough.

37. The method of claim 36, further comprising the step of:

selecting said activation temperature by selecting a material to form said thermally sensitive member from which melts at said activation temperature.

38. A method for preventing an electrical current from passing through a conductive pathway extending between a power supply and an electrically operated downhole well tool until after said downhole well tool is lowered downhole within a wellbore, said method comprising the steps of:

disposing a thermally sensitive material within said conductive pathway to prevent said electrical current from passing through said conductive pathway;

disposing a first conductive member to a first end of said temperature sensitive member for electrically connecting to said power supply prior to lowering said apparatus within said wellbore;

disposing a second conductive member to a second end of said temperature sensitive member for electrically connecting to said electrically operated downhole well tool prior to lowering said apparatus within said wellbore;

lowering said apparatus with said electrically operated downhole well tool into said wellbore to a downhole depth within said wellbore; and heating said thermally sensitive material to a predetermined temperature, at which said thermally sensitive material softens for passing one of said first and second conductive members therethrough for passing of said electrical current therebetween, and provide at least a portion of said conductive pathway between said power supply and said electrically operated downhole well tool.

39. The method of claim 38, further comprising the step of:

securing a tester member between said first and second conductive members for providing a testing conductive pathway therebetween to test for proper assembly of said apparatus with said electrically operated downhole well tool prior to lowering said apparatus and said downhole well tool within said wellbore.

40. The method of claim 39, wherein said tester member will prevent passage of an electrical current therethrough which exceeds a predetermined current level.

* * * * *